US008925473B2

(12) United States Patent
Eklund et al.

(10) Patent No.: US 8,925,473 B2
(45) Date of Patent: Jan. 6, 2015

(54) THREAD CUT WITH VARIABLE THREAD CONSUMPTION IN A SEWING MACHINE

(75) Inventors: Henrik Eklund, Tenhult (SE); Tom Dolk, Skovde (SE)

(73) Assignee: VSM Group AB, Huskvarna (SE)

( * ) Notice: Subject to any disclaimer, the term of this patent is extended or adjusted under 35 U.S.C. 154(b) by 1277 days.

(21) Appl. No.: 12/680,736

(22) PCT Filed: Sep. 29, 2008

(86) PCT No.: PCT/SE2008/051094

§ 371 (c)(1),
(2), (4) Date: Dec. 18, 2010

(87) PCT Pub. No.: WO2009/061258

PCT Pub. Date: May 14, 2009

(65) Prior Publication Data

US 2011/0094426 A1 Apr. 28, 2011

Related U.S. Application Data

(60) Provisional application No. 60/996,306, filed on Nov. 9, 2007.

(51) Int. Cl.

| | |
|---|---|
| ***D05B 19/00*** | (2006.01) |
| ***D05B 45/00*** | (2006.01) |
| ***D05B 65/02*** | (2006.01) |
| ***D05B 65/06*** | (2006.01) |
| ***D05B 69/22*** | (2006.01) |

(52) U.S. Cl.

CPC ..... *D05B 45/00* (2013.01); *D05B 65/02* (2013.01); *D05B 65/06* (2013.01); *D05B 69/22* (2013.01)

USPC ..... 112/470.05

(58) Field of Classification Search

USPC ..... 112/470.05, 470.01, 470.03, 223, 225, 112/226, 285, 293, 294, 300, 253, 302, 112/475.17, 475.05

See application file for complete search history.

(56) References Cited

U.S. PATENT DOCUMENTS

| | | | |
|---|---|---|---|
| 286,662 | A | 10/1883 | Wendell |
| 590,726 | A | 9/1897 | Merrick |
| 3,550,544 | A | 12/1970 | Fairfield et al. |
| 3,570,426 | A | 3/1971 | Kunes |

(Continued)

FOREIGN PATENT DOCUMENTS

| | | | |
|---|---|---|---|
| CA | 1081544 | A1 | 7/1980 |
| CA | 2515406 | A1 | 8/2004 |

(Continued)

*Primary Examiner* — Tejash Patel
(74) *Attorney, Agent, or Firm* — Lando & Anastasi, LLP

(57) ABSTRACT

A method and a device for cutting at least an upper thread of a sewing machine provided with a fabric clamping member (20), wherein a length of the thread consumed for a cut can be set within a predetermined interval. The method for cutting at least the upper thread (4) of a sewing machine (1) includes the steps: feeding a predetermined length x of said upper thread (4) utilizing a thread feeder (15), pulling out the upper thread (4) said predetermined length utilizing a displacement of said fabric clamping member (20) from a current position to a second position executing by means of a sewing machine processor (C) program sequences stored in a memory (M) for controlling a thread cutter (10) to perform a cut of at least said upper thread (4).

6 Claims, 7 Drawing Sheets

(56) References Cited

U.S. PATENT DOCUMENTS 3,585,950 A 6/1971 Ito
3,589,320 A 6/1971 Beazley
3,592,153 A 7/1971 Margereson
3,613,608 A 10/1971 Hinerfeld et al.
3,613,610 A 10/1971 Hinerfeld et al.
3,693,561 A 9/1972 Hrinko, Jr. et al.
3,698,334 A 10/1972 Kleinschmidt et al.
3,712,254 A 1/1973 Beamish et al.
3,721,204 A 3/1973 Schaffer et al.
3,727,567 A 4/1973 Beazley
3,763,805 A 10/1973 Weigert
3,799,087 A 3/1974 Beamish et al.
3,815,531 A 6/1974 Wurst et al.
3,818,849 A 6/1974 Maddox, Jr.
3,904,890 A 9/1975 Wenrich et al.
3,967,566 A 7/1976 Spiegel et al.
4,051,794 A 10/1977 Herzer et al.
4,073,247 A 2/1978 Cunningham et al.
4,092,937 A 6/1978 Landau, Jr. et al.
4,098,208 A 7/1978 Hedegaard
4,100,865 A 7/1978 Landau, Jr. et al.
4,104,976 A 8/1978 Landau, Jr. et al.
4,108,090 A 8/1978 Landau, Jr. et al.
4,116,145 A 9/1978 Nicolay
4,133,275 A 1/1979 Herzer et al.
4,154,179 A 5/1979 Arnold
4,160,422 A 7/1979 Barber et al.
4,181,085 A 1/1980 Conner, Jr.
4,185,575 A 1/1980 Brown et al.
4,195,582 A 4/1980 Novick et al.
4,214,540 A 7/1980 Cook
4,221,176 A 9/1980 Besore et al.
4,246,858 A 1/1981 Ogawa
4,324,191 A 4/1982 Brown
4,351,254 A 9/1982 Brown
4,352,334 A 10/1982 Childs et al.
4,359,008 A 11/1982 Newman
4,365,565 A 12/1982 Kawai et al.
4,373,458 A 2/1983 Dorosz et al.
4,373,459 A 2/1983 Dunn et al.
4,391,215 A 7/1983 Sansone
4,393,343 A 7/1983 Angersbach et al.
4,409,914 A 10/1983 Sansone
4,412,498 A 11/1983 Scholl
4,414,909 A 11/1983 Bray
4,426,947 A 1/1984 Marshall
4,457,246 A 7/1984 Hanyu et al.
4,467,739 A 8/1984 Hager et al.
4,479,448 A 10/1984 Jones et al.
4,502,400 A 3/1985 Walther
4,503,794 A 3/1985 Ishihara et al.
4,507,596 A 3/1985 Angersbach et al.
4,509,443 A 4/1985 Martell et al.
4,513,676 A 4/1985 Martell et al.
4,519,331 A 5/1985 Kosrow et al.
4,526,114 A 7/1985 Martell et al.
4,526,116 A 7/1985 Ma/ nnel
4,555,997 A 12/1985 Tancs
4,557,207 A 12/1985 Turner et al.
4,563,964 A 1/1986 Sjodin
4,569,297 A 2/1986 Dusch
4,622,907 A 11/1986 Kimura
4,648,337 A 3/1987 Mall
4,677,926 A 7/1987 Dusch et al.
4,682,554 A 7/1987 Goto et al.
4,686,917 A 8/1987 Braun
4,706,584 A 11/1987 Senda et al.
4,706,587 A 11/1987 Shiomi
4,726,307 A 2/1988 Yamauchi
4,726,309 A 2/1988 Popp
4,742,786 A 5/1988 Hashimoto et al.
4,748,920 A 6/1988 Stutznacker
4,757,773 A 7/1988 Nomura et al.
4,781,130 A 11/1988 Badowski
4,794,875 A 1/1989 Noguchi et al.
4,803,937 A 2/1989 Hiramatsu et al.
4,815,406 A 3/1989 Brown et al.
4,834,008 A 5/1989 Sadeh et al.
4,841,891 A 6/1989 Hashimoto et al.
4,849,902 A 7/1989 Yokoe et al.
4,860,678 A 8/1989 Skogward
4,867,082 A 9/1989 Sabbioni et al.
4,867,087 A 9/1989 Suzuki et al.
4,932,343 A 6/1990 Mardix et al.
4,982,677 A 1/1991 Nomura et al.
4,995,328 A 2/1991 Tanaka
5,000,105 A 3/1991 Tanaka
5,012,752 A 5/1991 Murata et al.
5,018,466 A 5/1991 Hasegawa
5,095,835 A 3/1992 Jernigan et al.
5,138,962 A 8/1992 Klundt
5,146,862 A 9/1992 Sato et al.
5,156,106 A 10/1992 Suzuki et al.
5,156,107 A 10/1992 Kyuno et al.
5,184,560 A 2/1993 Asano
5,270,939 A 12/1993 Goldberg et al.
5,303,665 A 4/1994 Hausammann
5,319,565 A 6/1994 Hausammann et al.
5,323,722 A 6/1994 Goto et al.
5,347,940 A 9/1994 Hori et al.
5,389,868 A 2/1995 Mikami et al.
5,410,976 A 5/1995 Matsubara
5,474,005 A 12/1995 Yamauchi et al.
5,477,795 A 12/1995 Nakayama et al.
5,481,995 A 1/1996 Hiratsuka et al.
5,537,939 A 7/1996 Horton
5,537,946 A 7/1996 Sadeh et al.
5,562,059 A 10/1996 Yamauchi et al.
5,571,240 A 11/1996 Yamauchi et al.
5,588,383 A 12/1996 Davis et al.
5,592,891 A 1/1997 Muto
5,603,272 A 2/1997 Takahashi et al.
5,653,186 A 8/1997 Yamauchi et al.
5,701,830 A 12/1997 Muto
5,740,055 A 4/1998 Iwata
5,755,240 A 5/1998 Schonborn
5,791,270 A 8/1998 Mori
5,911,182 A 6/1999 Uyama et al.
5,924,372 A 7/1999 Okuda et al.
5,974,997 A 11/1999 Amburgey
6,032,595 A 3/2000 Okuyama
6,131,526 A 10/2000 Iida et al.
6,135,038 A 10/2000 Okamoto
6,202,001 B1 3/2001 Muto
6,209,468 B1 4/2001 Marcangelo et al.
6,293,210 B1 9/2001 Freeman et al.
6,321,670 B1 11/2001 Tomita et al.
6,381,818 B1 5/2002 Freeman et al.
6,718,895 B1 4/2004 Fortuna
6,729,255 B2 5/2004 Ton et al.
6,732,668 B2 5/2004 Zesch et al.
6,736,077 B2 5/2004 Pokrishevsky et al.
6,823,807 B2 11/2004 Zesch et al.
6,871,605 B1 3/2005 Zesch et al.
6,883,446 B2 4/2005 Koerner
6,883,449 B2 4/2005 Burrell et al.
6,963,790 B2 11/2005 Mizuno et al.
6,983,192 B2 1/2006 Block et al.
7,210,417 B2 5/2007 Koerner
7,212,880 B2 5/2007 Mizuno et al.
7,225,747 B2 * 6/2007 Friman et al. ..... 112/475.01
7,240,628 B2 * 7/2007 Friman et al. ..... 112/475.01
7,308,333 B2 12/2007 Kern et al.
7,412,936 B2 8/2008 Price et al.
7,460,925 B2 12/2008 Noguchi
7,793,602 B2 9/2010 Koemer
7,814,832 B2 10/2010 Franz
8,261,679 B2 9/2012 Ihira et al.
8,387,547 B2 3/2013 Bardh et al.
2002/0043202 A1 4/2002 Freeman et al.
2003/0140829 A1 7/2003 Zesch et al.
2003/0140830 A1 7/2003 Pokrishevsky et al.
2003/0140831 A1 7/2003 Zesch et al.
2003/0140832 A1 7/2003 Ton et al.

(56) References Cited

U.S. PATENT DOCUMENTS

| | | | |
|---|---|---|---|
| 2004/0210336 | A1 | 10/2004 | Block et al. |
| 2005/0016428 | A1 | 1/2005 | Koerner |
| 2006/0064195 | A1 | 3/2006 | Kern et al. |
| 2006/0213413 | A1 | 9/2006 | Koerner |
| 2007/0204781 | A1 | 9/2007 | Noguchi |
| 2007/0256619 | A1 | 11/2007 | Koemer |
| 2007/0272135 | A1 | 11/2007 | Fujihara |
| 2010/0224111 | A1 | 9/2010 | Ihira et al. |
| 2011/0005441 | A1 | 1/2011 | Roche |
| 2011/0041746 | A1 | 2/2011 | Eklund et al. |
| 2011/0146553 | A1 | 6/2011 | Wilhelmsson et al. |
| 2011/0168070 | A1 | 7/2011 | Lanquist |
| 2011/0303138 | A1 | 12/2011 | Flygare et al. |
| 2012/0060733 | A1 | 3/2012 | Maki et al. |
| 2012/0060734 | A1 | 3/2012 | Yamanashi et al. |
| 2012/0234222 | A1 | 9/2012 | Naka |
| 2013/0014682 | A1 | 1/2013 | Brindzik |
| 2013/0042797 | A1 | 2/2013 | Bondesson et al. |

FOREIGN PATENT DOCUMENTS

| | | | |
|---|---|---|---|
| DE | 102007001073 | A1 | 8/2007 |
| EP | 39680 | A1 | 11/1981 |
| EP | 77788 | A1 | 5/1983 |
| EP | 103364 | A2 | 3/1984 |
| EP | 117713 | A1 | 9/1984 |
| EP | 124211 | A1 | 11/1984 |
| EP | 366140 | A1 | 5/1990 |
| EP | 515131 | A1 | 11/1992 |
| EP | 564771 | A2 | 10/1993 |
| EP | 857228 | A1 | 8/1998 |
| EP | 1184502 | A1 | 3/2002 |
| EP | 1777331 | A1 | 4/2007 |
| EP | 2226419 | A1 | 9/2010 |
| GB | 191124452 | A | 0/1912 |
| GB | 1179964 | A | 2/1970 |
| GB | 1179965 | A | 2/1970 |
| GB | 1182563 | A | 2/1970 |
| GB | 1200024 | A | 7/1970 |
| GB | 1282153 | A | 7/1972 |
| GB | 1310091 | A | 3/1973 |
| GB | 1315001 | A | 4/1973 |
| GB | 1320764 | A | 6/1973 |
| GB | 1320765 | A | 6/1973 |
| GB | 1349994 | A | 4/1974 |
| GB | 1375540 | A | 11/1974 |
| GB | 1393294 | A | 5/1975 |
| GB | 1440350 | A | 6/1976 |
| GB | 1475791 | A | 6/1977 |
| GB | 1526209 | A | 9/1978 |
| GB | 1547931 | A | 7/1979 |
| GB | 1547932 | A | 7/1979 |
| GB | 1547933 | A | 7/1979 |
| GB | 1547934 | A | 7/1979 |
| GB | 2028388 | A | 3/1980 |
| GB | 1568486 | A | 5/1980 |
| GB | 1570241 | A | 6/1980 |
| GB | 1570242 | A | 6/1980 |
| GB | 1570243 | A | 6/1980 |
| GB | 1570244 | A | 6/1980 |
| GB | 1570245 | A | 6/1980 |
| GB | 1571736 | A | 7/1980 |
| GB | 2043124 | A | 10/1980 |
| GB | 1583629 | A | 1/1981 |
| GB | 2157723 | A | 10/1985 |
| GB | 2168085 | A | 6/1986 |
| GB | 2177520 | A | 1/1987 |
| GB | 2204604 | A | 11/1988 |
| JP | 1212591 | A | 8/1989 |
| JP | 02055080 | A | 2/1990 |
| JP | 2000167277 | A | 6/2000 |
| JP | 2000342869 | A | 12/2000 |
| JP | 6304359 | A | 7/2007 |
| JP | 2009011594 | A | 1/2009 |
| JP | 2009233435 | A | 10/2009 |
| JP | 2010185151 | A | 8/2010 |
| KR | 198800714 | B1 | 4/1988 |
| WO | 8101020 | A1 | 4/1981 |
| WO | 8203879 | A1 | 11/1982 |
| WO | 8901067 | A1 | 2/1989 |
| WO | 9715708 | A1 | 5/1997 |
| WO | 0104405 | A1 | 1/2001 |
| WO | 2004072349 | A2 | 8/2004 |
| WO | 2006071786 | A2 | 7/2006 |
| WO | 2007143062 | A2 | 12/2007 |
| WO | 2010144013 | A1 | 12/2010 |

* cited by examiner

THREAD CUT WITH VARIABLE THREAD CONSUMPTION IN A SEWING MACHINE

TECHNICAL FIELD

The present invention relates to a device for cutting the threads in a sewing machine, which operates with one lower and at least one upper thread.

BACKGROUND OF THE INVENTION

Thread cut devices for sewing machines, using an upper thread and a lower thread, are used to automatically cut one or both threads. When a cut has been performed during a cut sequence a specific amount of thread has been consumed, since a short piece of thread is normally left under a fabric on which stitches are sewn. Furthermore, a short piece of thread goes through an eye of a needle involved in the stitches, in a known way, and will be consumed when the sewing starts again after a cut sequence. The total thread length used for the sewing of a stitch sequence will therefore be the sum of the thread used for the stitches plus the sum of the thread length that goes out of the eye of the needle at the start of the stitch sequence and the thread length pulled down under the fabric after a cut performed at the end of the stitch sequence.

During specific types of use of a sewing machine, e.g. in embroidery mode, said thread length consumed for the pull down of thread under the fabric can be used when an extra thread consumption is desirable. One example of a situation where an upper thread consumption could be preferable is connected with systems for thread colouring, such as in the sewing machine described in US 20070245940 A1. Said document states that a thread cut may be used to compensate for a possibly incorrect position of a colour change point of the upper thread in relation to a desired colour change of the upper thread as specified according to stitch data. The principle discussed in said document is based on the assumption that a faulty position of the colour change point of the upper thread, after a cut has been performed, is positioned below the fabric. This implies that the position of the thread colour change point is positioned on the piece of thread that has been pulled down under the fabric for carrying out the cut. On conventional sewing machines, provided with a thread cutter controlled by a processor, a typical length of the upper thread pulled out for the cut is around 25 mm (herein referred to as length d). This length d limits the possibilities to adjust a greater error of the position of the colour change point, as well as it limits the possibility for the performance of fine adjustment of the thread length consumed during a cut of the thread.

SUMMARY OF THE INVENTION

The present invention is devoted to a method for cutting at least an upper thread of a sewing machine, wherein a length of the thread consumed for a cut can be set within a predetermined interval.

According to one aspect of the invention a method with the characteristics of the appended claim 1 is presented.

According to a further aspect of the invention a sewing machine with the characteristics of the enclosed independent device claim is presented.

Further aspects and embodiments of the invention are presented in the dependent claims.

One advantage with the use of the method of the invention is that the length of the at least upper thread consumed in a cut can be controlled by the processor of the sewing machine. This circumstance can be used for different purposes and can be used as an operating step possible to be programmed into a program controlling the operation of the sewing machine. As one example, the thread cutter can be ordered to cut the upper thread, wherein the thread consumed in the cut is set to amount to a predetermined length. The extra upper thread length provided can then be used e.g. to hide a colour change point on the under side of the fabric used or to assess a definite predetermined length being consumed for other purposes, such as the possibility of fine adjustments.

The cut described and performed according to the invention can also be used to increase the consumption of upper thread for other purposes, e.g. to prevent the thread from being pulled out of the eye of the needle after a cut. This is a problem in some sewing machine systems, because the thread length consumed in a cut can not be set freely. The thread length after a cut carried out according to the inventive method results in an increased thread length consumed on both sides of the fabric, i.e. the length of the thread extending through the eye of the needle will also be increased in the same proportion. By increasing the amount of the upper thread extending through the eye of the needle the risk of the thread being pulled out from the eye is reduced.

DESCRIPTION OF EMBODIMENTS

Below the invention will be explained in greater detail by description of embodiments with reference to the accompanying drawings.

Current thread cut systems used in a conventional sewing machine provided with a processor controlled thread cutter are designed to automatically cut one or both threads, i.e. the upper thread or both the upper thread and the under thread. One side effect of such an automatically performed thread cut is that some thread is consumed when a cut sequence is performed. As stated, this fact may be utilized when extra thread consumption is desirable.

The amount of thread consumed when a thread cut is performed is normally constant (length d is consumed). However, when the reason for performing a cut partly is to consume some thread, it would be desirable to be able to specify the amount of thread that shall be consumed. The present invention provides and describes an algorithm that makes it possible to consume an arbitrary amount of thread within a given interval, when a thread cut is performed.

Figure 1:
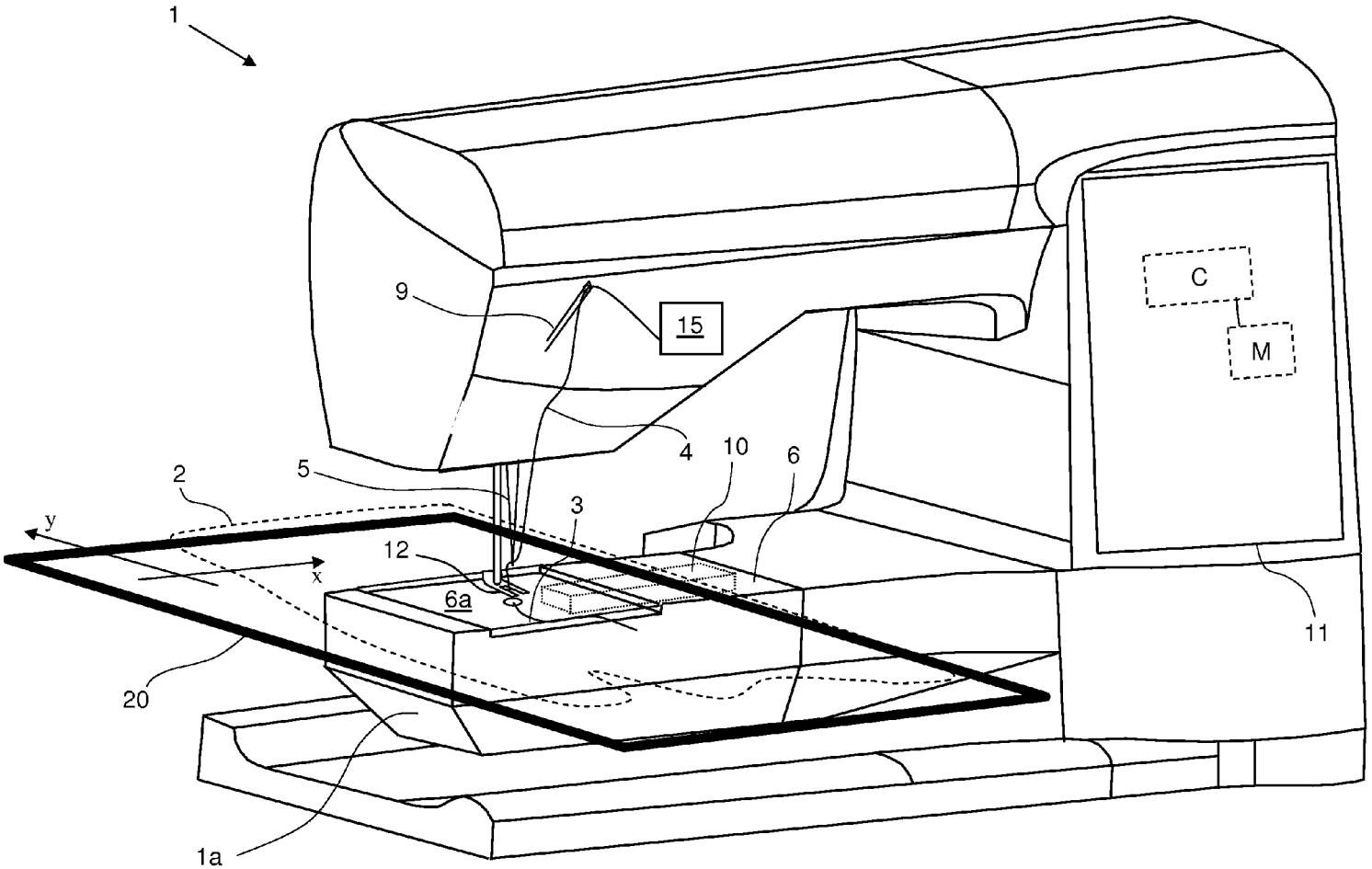
FIG. 1 schematically shows a sewing machine in perspective being provided with the accessories needed for performing the method according to the invention.

By way of example, a lock stitch sewing machine for performing the inventive method is described in FIG. 1, which symbolically depicts a sewing machine 1, where in a conventional manner a fabric 2 is fed forward, conventionally utilizing a feeder, between an under thread 3 and an upper thread 4 in order to execute a desired embroidery comprising stitches effected by means of a needle 5 which moves periodically through the fabric 2. In this example, the fabric 2 is moved across a sewing table 6, which also accommodates a horizontally disposed bottom thread bobbin 13 (FIG. 4*a*-4*d*) intended for the bottom thread 3 and encased in a gripper 14 in a lower arm la of the sewing machine. The sewing table 6 also has a stitch plate 6*a*, over which the actual seam is executed. A presser foot 12 holds the fabric to the stitch plate. The upper thread 4 is led via a take-up lever 9, which by a cyclic up and down movement creates a loop of the upper thread 4 when the needle 5, through the eye of which the upper thread runs, has carried the upper thread through the fabric 2 and the take-up lever 9 reverses back upwards from its lowest position. A gripper tip (not shown) hooks into the loop when the gripper 14 rotates. To execute a stitch, in this case a lock stitch, the needle 5 performs reciprocating movements so that it leads the upper thread 4 down through the fabric 2, after which the gripper leads the upper thread 4 round the bobbin, which carries the bottom thread 3, resulting in a knot in the fabric 2 when the needle 5 moves up through the fabric and the take-up lever 9 tightens the knot in the fabric. A main motor coupled to shafts of the sewing machine drives the needle 5, the take-up lever 9, the feeder and the gripper 14 to synchronize the movements of these members in a manner well known in the art.

The machine is provided with a control program which, for example, is stored in a processor C. Further the sewing machine has an available memory M, preferably being accommodated in the machine, although the memory M as well may be external and accessible from the processor C. In the memory M sewing machine embroidery elements for composing embroideries may be stored in the form of stitch data. A display 11 is provided, on which the images representing embroidery elements can be displayed to a user.

In FIG. 1 is also shown an embroidery frame 20 arranged with the sewing machine. A piece of fabric 2 is clamped in the embroidery frame 20. The piece of fabric 2 is only symbolically shown, thereby in the figure covering only a part of the embroidery frame and illustrated by means of dashed lines to make the arrangement more illustrative. The embroidery frame 20 is attached to an embroidery unit controlled by the processor C, wherein said embroidery unit includes a first feeding means operated by a first step motor (not shown) for operating the embroidery frame in an x-direction. The embroidery frame 20 is in a corresponding manner attached to a second feeding means of the embroidery unit and correspondingly operated by a second step motor (not shown) operating the embroidery frame in a y-direction. By a control of the first and second step motors with signals from the processor C the embroidery frame 20, along with the housed clamped piece of fabric, may be steered to be displaced in an arbitrary direction in the xy-plane.

Note: Generally, the term embroidery frame is referred to as a fabric clamping member and as such used in the claims as other types of devices than frames could be used for the same purpose and as such being controlled by the embroidery unit.

When conventional embroidery is performed in an embroidery machine of the discussed type the machine controls the movements of the embroidery frame fully according to stitch data stored in the memory M of the sewing machine according to all aspects concerning stitch types, sewing directions and so on according to prior art.

The sewing machine 1 is further provided with a thread cutter 10 for cutting the upper thread 4 or both threads 3, 4 between stitch sequences. A thread cutter 10 is symbolically shown in FIG. 1. An example of a thread cutter, which can be used for arriving at the object of the invention, is described in document U.S. Pat. No. 6,276,289 (D2), the content of which in its entirety is hereby incorporated into the present description of the invention. For illustrative purposes the known thread cutter of document D2 is briefly described below with reference to drawings 4*a*-4*d* as some program steps of the present invention refer to positions of a thread fetcher used to catch the thread during a cut sequence. The present invention uses a known thread cutter controlled by means of program steps stored in a memory M read by the processor C. A thread tension control system for controlling the tension of the upper thread is also part of prior art, the function of which is not further described here.

Figure 2:
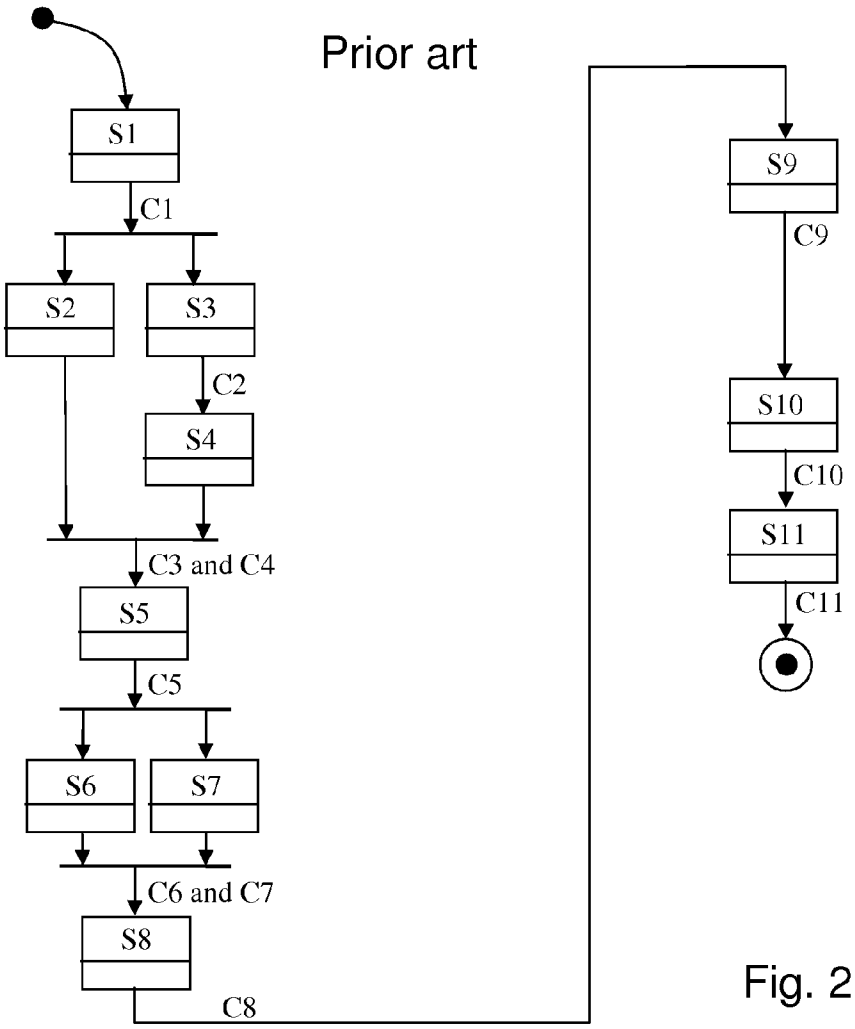
FIG. 2 is a flow chart indicating the steps for performing a thread cut according to prior art.

The program steps performed according to an algorithm controlling a thread cut according to prior art is listed below. In order to understand the process steps some abbreviations used are listed in the table below. A flow chart describing the different steps of the algorithm is illustrated in FIG. 2.

| Abbreviation | Description |
|---|---|
| SX | State with identity X |
| CX | Transition trigger with identity X |
| SECTOR X | SECTOR refers to a specific angle interval of the sewing machine main shaft. E.g. a specific machine uses an angle sensor for the main shaft that is divided into 16 slots, i.e. each slot corresponds to 22.5°. Each additional sector step thus corresponds to an increase of the main shaft angle by 22.5°.<br>SECTOR 12 corresponds to a position where the needle just has passed the topmost position.<br>SECTOR 0 corresponds to a position where the needle has just started to penetrate the fabric. |
| MOTION 2 TENSION | A thread tension (very low) suitable when the thread fetcher performs motion 2. |
| CUT TENSION | A thread tension (relatively low) suitable when the thread fetcher pulls the thread towards a knife present in the thread cutter. |
| Pos. 0 | No feeding of the fabric by means of a feeder, if a feeder exists. |

The software control algorithm for controlling a cut according to prior art:

S1: Set upper thread control system in tension mode.
C1: Upper thread control system in reached tension mode.
S2: Set the presser foot in DOWN pos. (the presser foot is lowered to the fabric)
S3: Set the main motor in SECTOR 0
C2: Main motor stopped in SECTOR 0
S4: Set the fabric feeder in pos. 0
C3: Presser foot in DOWN pos.
C4: Fabric feeder in pos. 0
S5: Start thread fetcher, motion 1. (As an example: Motion 1 is the advance of the thread fetcher from the position shown in FIG. 4*a* to the position shown in FIG. 4*b*)
C5: Motion 1 performed
S6: Set the main motor in SECTOR 12.
S7: Set thread tension (MOTION 2 TENSION).
C6: Main motor passed SECTOR 12
C7: Thread tension set
S8: Start thread fetcher, motion 2. (As an example: Motion 2 is the withdrawal of the thread fetcher from the position shown in FIG. 4*c* to a position to the left. This left position for the thread fetcher is approximately ⅕ to the right from its position shown in FIG. 4*d*.)
C8: Motion 2 performed
S9: Set thread tension (CUT TENSION)
C9: Thread tension set
S10: Start thread fetcher, motion 3. (As an example: Motion 3 is the removal from the position after S8 has been performed to the position shown in FIG. 4*d*.)
C10: Motion 3 performed.

S11: Calibrate the thread fetcher motor. Normally the calibration doesn't change the position of the fetcher, but if some problem has occurred so that the return movement of the fetcher has been restrained the calibration increases the probability of moving the fetcher to its end position.

C18: Calibration performed.

A thread cut system for setting the thread length consumed during a cut according to the invention is described hereafter.

When a cut with a predetermined thread length consumption d+x shall be performed some additional actions are necessary (compared to a cut with fixed (d) thread length consumption). The differences between a cut sequence with fixed thread consumption d and a cut with a variable predetermined thread consumption d+x is made clear by studying FIG. 2 and FIG. 3 respectively. States with the same name in the figures implies that the same action is performed, i.e. a state that is only found in one flow chart indicates a difference between the algorithm according to prior art and the algorithm according to the invention.

The additional length x of the upper thread 4 is according to the invention during a cut performed by first feeding the appropriate amount of upper thread 4 with the upper thread control system using the thread feeder 15 (An example of a thread feeder for actually feeding a thread out, instead of conventionally drawing the thread out from a thread store utilizing e.g. a take-up-lever, is described in document U.S. Pat. No. 7,240,628). When the thread has been fed the embroidery unit is moved to pull out the appropriate amount of thread under and above the fabric 2 respectively, i.e. the same amount of extra thread is provided under and above the fabric respectively. The extra thread consumed x (depending on an amount x/2 being drawn on each side of the fabric) corresponds to the movement carried out by the embroidery unit. The extra thread length x can be infinitely variable within an interval determined by highest possible displacement carried out by the embroidery unit. However, the thread consumption can never be lower than the amount of thread d (approx. 25 mm) consumed when a "normal" cut is performed.

The embroidery unit, as previously stated, controls the displacement of the fabric, e.g. by moving an embroidery frame 20, wherein the fabric 2 is clamped. The extra length x of the thread, when a cut is performed according to the present invention, wherein the embroidery unit is controlled by the processor C to draw the upper 4 and under 3 thread out during the cutting procedure, is then depending on the actual position of the needle in relation to the embroidery frame 20. The maximum thread length L that can be drawn by use of the embroidery unit is thus the maximum possible displacement that can be performed by controlling the embroidery unit to displace the embroidery frame 20 to the most remote point away from the actual position of the needle when the cut is initiated. As an example, if a rectangular embroidery frame 20 having a diagonal length k is used for clamping the fabric, the maximum extra thread length L=2k occurs if the actual position of the needle, when a cut is initiated according to the invention, is at the very corner of the rectangular embroidery frame 20 and the embroidery frame is controlled by the embroidery unit to be displaced the diagonal distance k in such a way that the needle will be positioned at the farthest corner diagonally across the rectangular embroidery frame 20. If other than rectangular shapes of an embroidery frame 20 are used, the maximum extra thread length L is easily found in a corresponding way.

Figure 3:
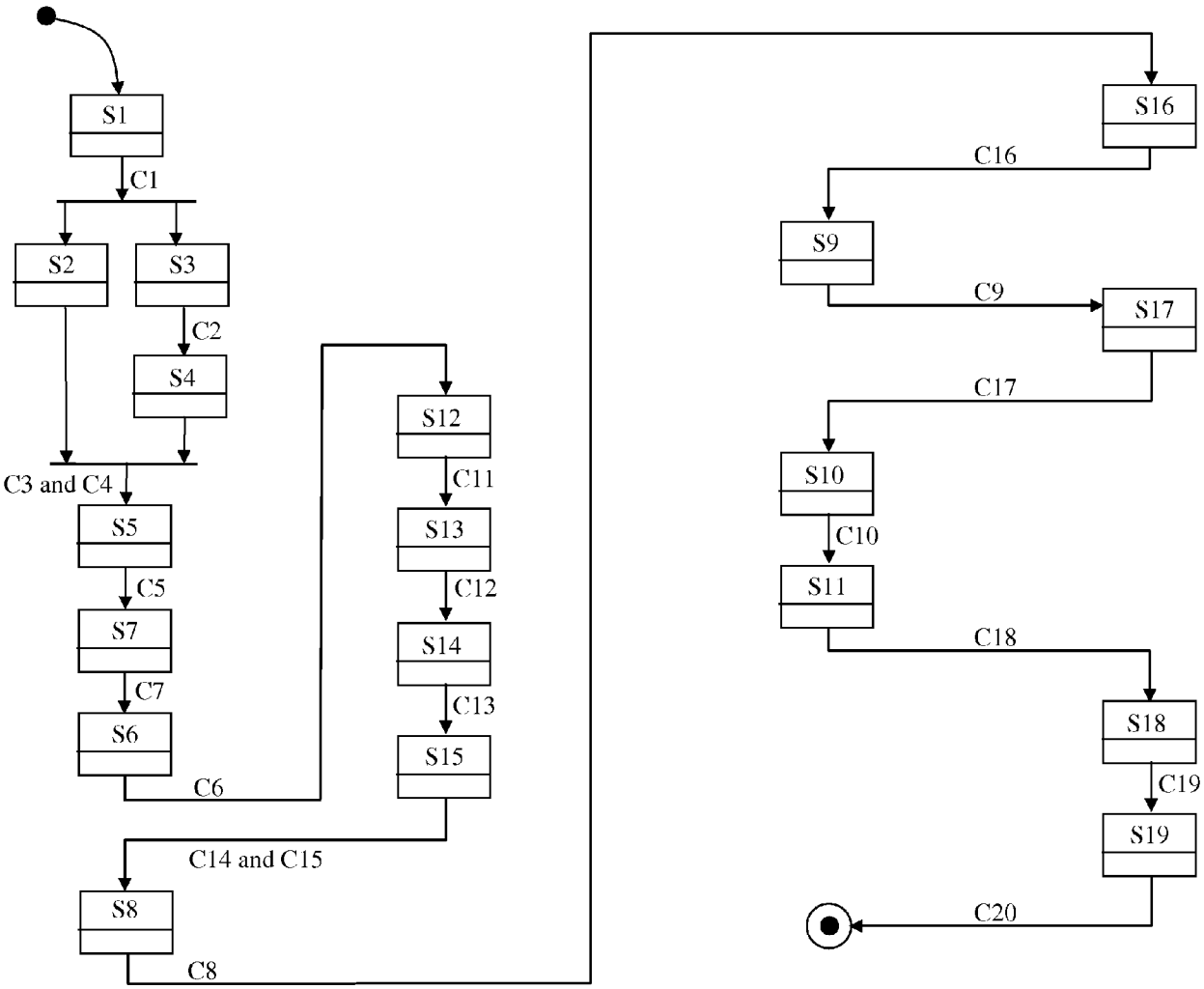
FIG. 3 is a flow chart indicating the steps for performing a thread cut according to the present invention.

The thread cut system able to provide arbitrary thread length consumption within the interval (d, d+L) uses the same mechanical parts as the current thread cut system. The variably consumed thread length in a cut is obtained by changing the software control of the system and by using the thread feed system and the embroidery unit to feed (using the thread feeder 15) respectively pull (using the embroidery unit) a predetermined amount of thread. The control of the system able to provide a variable thread length consumed in the cut is shown in FIG. 3.

C The additional steps, in relation to the prior art thread cut (in FIG. 3 the prior art steps are illustrated in column 1 and 3, whilst the additional steps are depicted in columns 2 and 4), of the method for performing the thread cut according to the present invention are listed and explained below in conjunction with FIG. 3:

S12: Set the presser foot in LIFT pos (the presser foot is set in its highest position). (The presser foot is lifted from DOWN pos. to allow the embroidery unit movement in S15)

C11: Presser foot in LIFT pos.

S13: Set the upper thread control system in feeding mode.

C12: Feeding mode set.

S14: Provide the amount of extra thread (x) to be consumed in the cut sequence. This is done by feeding the corresponding thread amount by the thread feeder 15.

C13: Delay (approx. 200 ms).

S15: Move the embroidery frame x/2 mm in a set direction. (The processor must be programmed to perform a movement of the embroidery frame in a direction a sufficient distance in relation to the present position of the needle vis-à-vis the embroidery frame.) (Example: At this moment, the thread fetcher and the upper and the lower threads respectively are positioned according to FIG. 4*c*. The thread fed by the upper thread feeder 15 (step S14) slides through the eye of the needle 5, through the fabric 2 and the thread fetcher when the embroidery frame 20 is moved.)

C14: Embroidery frame position set.

C15: Thread feed performed.

S16: Set the upper thread control system in tension mode.

C16: Tension mode set

S17: Set the presser foot in DOWN pos.

C17: DOWN pos. set

S18: Set the presser foot in PIVOT pos. (PIVOT pos. is achieved by setting the presser foot to a level just above the fabric)

C19: PIVOT pos. set.

S19: Move the embroidery frame −x/2 mm (to the pos. it had before the cut sequence started).

C20: Embroidery frame position set.

When a cut with a predetermined thread length consumption, as described above, shall be performed, the fabric 2 must be mounted in a hoop of some kind connected to an embroidery unit. This implies that the system can not be used in sewing mode when a conventional fabric feeder transports the fabric.

The thread cut described above admits arbitrary variable thread consumption within an interval being restricted only by the fabric clamping member (20) and the actual position of the needle in relation to said fabric clamping member (20). The extra length x/2 of the thread both over and under the fabric 2 will be of the same size. Normally it is desirable to change the length of the threads under the fabric only. However, in the prior art thread cut systems (with a fixed cut length d) the thread on the upper side of the fabric is sometimes too short after a cut. This part of the thread goes through the eye of the needle 5 and if it is too short there is a risk that the thread is pulled out of the eye of the needle when the sewing machine is started. The thread cut with a variable thread length x consumption as described here can be used to solve this problem. On the other hand, the upper thread is sometimes in prior art machines pulled down after a cut (and before the sewing starts again), (see further in [D2]). The prior art upper thread pull down algorithm requires a certain amount of thread out of the eye of the needle. If this length of thread is too long, it may risk the function of the upper thread pull down sequence. However, it may be possible to take this in consideration by pulling some thread back again, after the cut has been performed, utilizing the upper thread feeder (15).

Figure 4A:
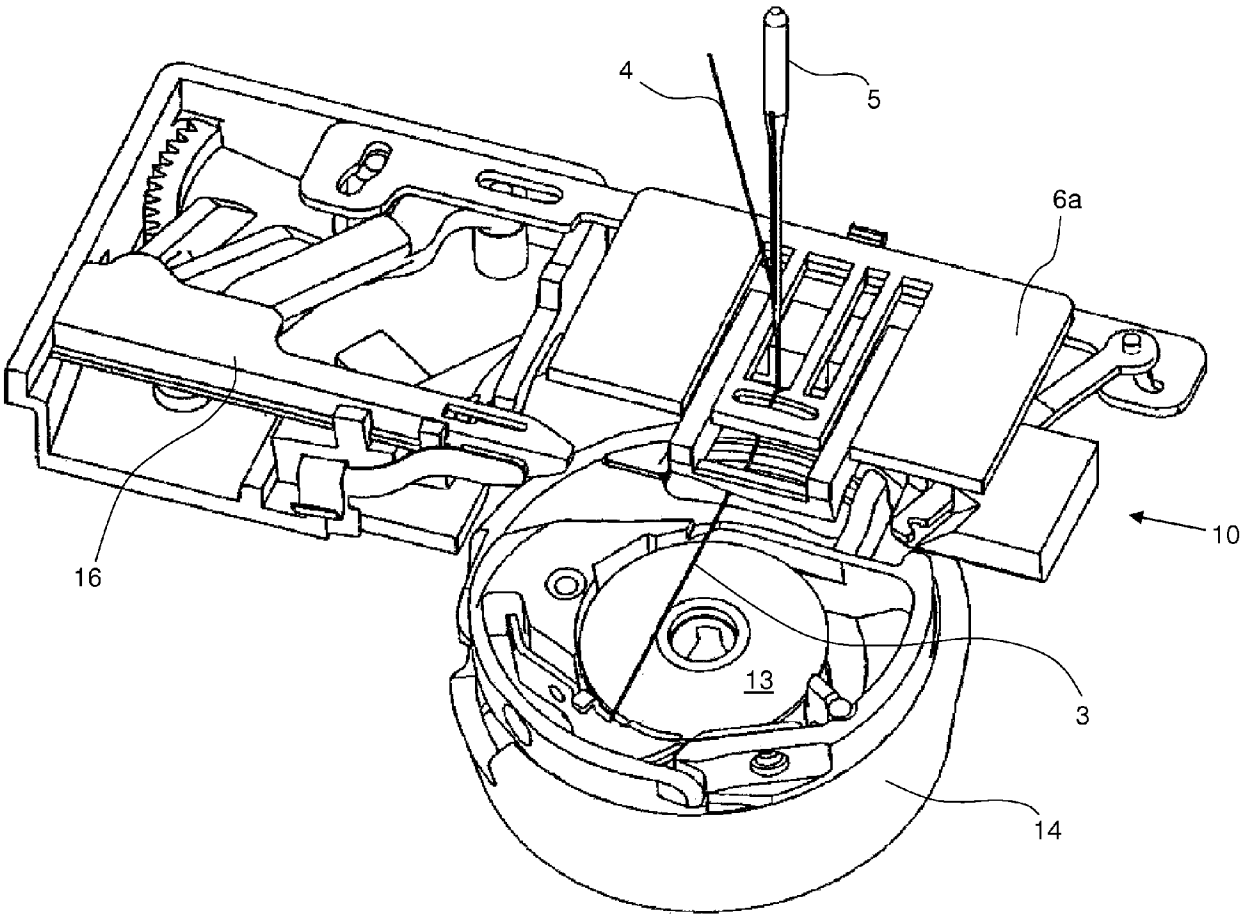
FIGS. 4*a*-4*d* shows an example of a thread cutter according to prior art, wherein different positions of a thread fetcher for catching the upper and under thread during a cut sequence is illustrated.
Figure 4B:
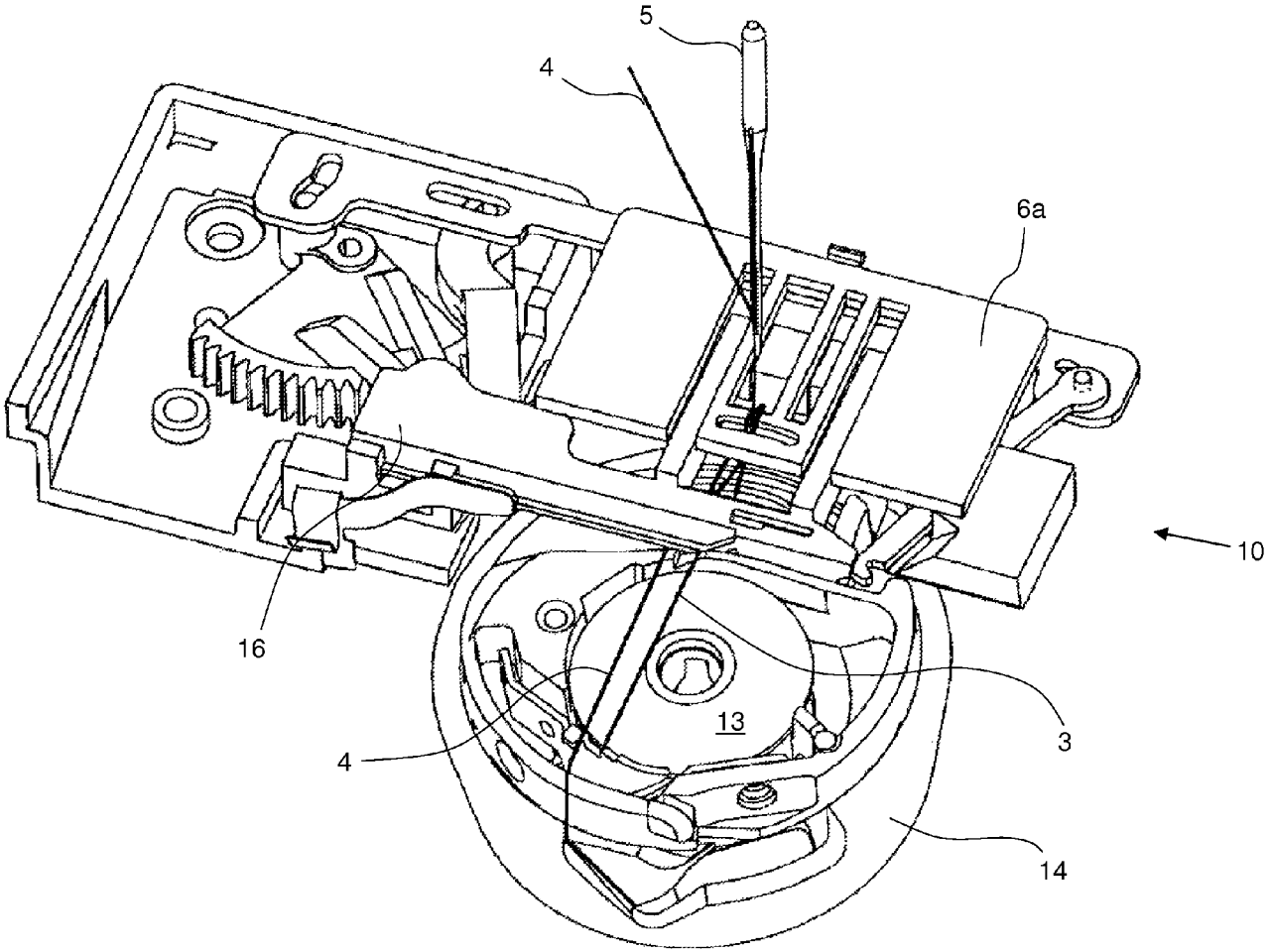
Figure 4C:
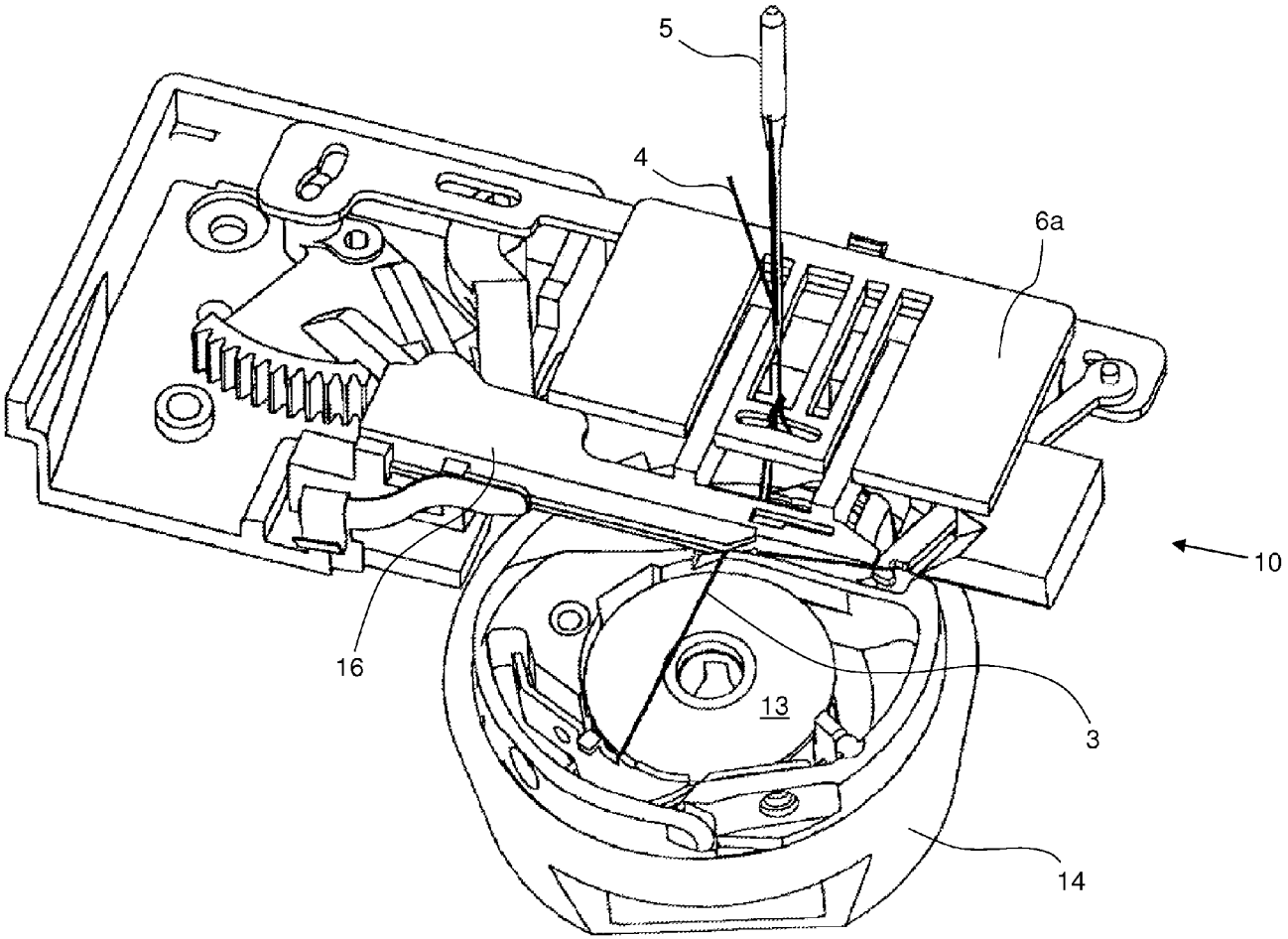
Figure 4D:
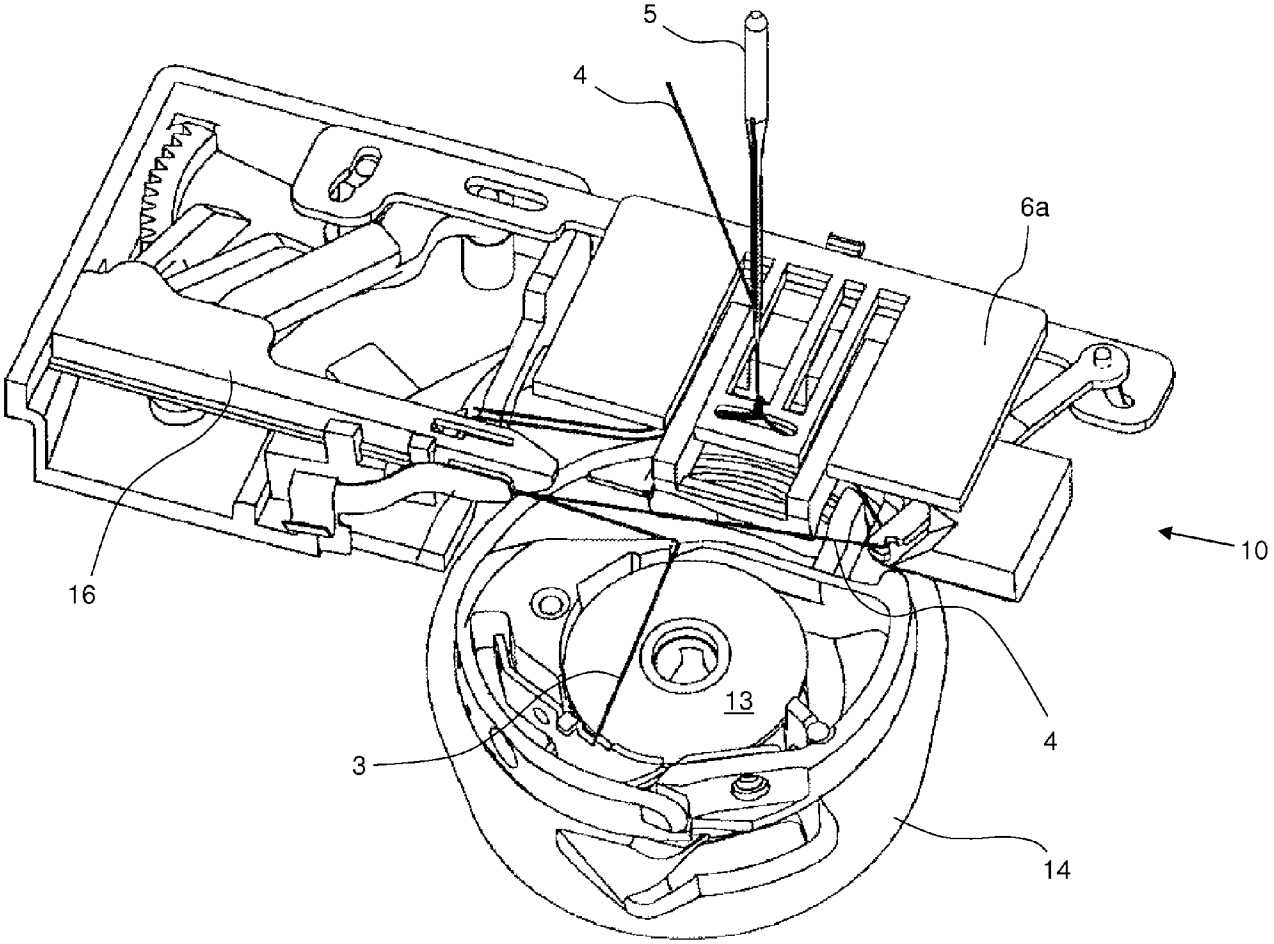

With reference to FIGS. 4*a*-4*d* an example of a thread cutter 10 according to prior art is illustrated and explained briefly for the understanding of the program steps listed above. The thread cutter 10 is disposed below the stitch plate 6*a*. Said thread cutter includes a thread fetcher 16, which is movable between different positions utilizing a thread fetcher motor. On its underside the thread fetcher 16 has a hook intended to catch and bring threads, which are to be cut. The thread fetcher 16 cooperates with a knife (not visible) for the cutting. In FIG. 4*a* the thread cutter is shown in a non-operable position, wherein the thread fetcher is in its left end position on the drawing. In FIG. 4*b*, the thread fetcher 16 has been displaced to the right on its way to catch the upper thread 4. This displacement of the thread fetcher shown as the position changes from FIG. 4*a* to FIG. 4*b* corresponds to motion 1 above. FIG. 4*c* then shows the full displacement of the thread fetcher 16 during a cut sequence, wherein the thread fetcher 16 is in its most right position, where it can also catch the under thread 3. The thread fetcher is then being returned to its end position to the left, whereupon the thread or the threads are brought into contact with the knife to be cut. At the position of the thread fetcher 16 indicated by FIG. 4*d* the cutting is terminated. The so called Motion 2 above corresponds to the change of the position of the thread fetcher 16 indicated in FIG. 4*c* to a position approximately ⅕ of the total stroke of the thread fetcher to the right of the position of the thread fetcher 16 indicated in FIG. 4*d*. Finally, Motion 3 referred to above is the remaining displacement back to the position the thread fetcher holds in FIG. 4*d*. For a full understanding of the cutting sequence for the exemplified thread cutter 10 it is referred to document D2 mentioned above.

What is claimed is:

1. A method for cutting at least an upper thread of a sewing machine, wherein a length of the thread consumed for a cut can be set within a predetermined interval, said sewing machine having a thread feeder for the upper thread, a thread cutter, a fabric clamping member, a processor for controlling said thread cutter, thread feeder, and fabric clamping member, and a memory, the sewing machine also having an adjustable height presser foot, the method comprising:

feeding by said thread feeder a predetermined length (x) of said upper thread to be consumed in a cut sequence, pulling out the upper thread said predetermined length by displacing a displacement of said fabric clamping member from a first position to a second position, instructing the processor to execute at least one program sequence stored in the memory, the at least one program sequence configured to operate said thread cutter to perform a cut of at least said upper thread.

2. The method according to claim 1, further comprising:

setting said predetermined length (x) of thread to be consumed to be $d<x\leq L=2k$, wherein d is the thread length consumed in a cut when said feeding and pulling is not performed and k is a maximum possible displacement of a needle within the fabric clamping member whereby said consumed thread can be set within the interval d to d+L, depending on the position of the needle when performing said cut.

3. The method according to claim 1 or 2, wherein said at least one program sequence executed by the processor of the sewing machine includes an algorithm having the steps of:

providing the predetermined amount of thread (x) to be consumed in the cut sequence;

moving the fabric x/2 mm in a set direction; and moving the fabric clamping member −x/2 mm to the position it had before the start of the cut sequence.

4. The method according to claim 3, wherein the processor is instructed to execute a program sequence having an algorithm including the steps of:

S1: Set upper thread control system in tension mode;
C1: Upper thread control system in reached tension mode;
S2: Set the presser foot in DOWN pos;
S3: Set a main shaft of the sewing machine in SECTOR 0;
C2: Main shaft stopped in SECTOR 0;
S4: Set the fabric feeder in pos. 0;
C3: Presser foot in DOWN pos;
C4: Fabric feeder in pos. 0;
S5: Start a thread fetcher of the thread cutter, motion 1;
C5: Motion 1 performed;
S7: Set thread tension;
C7: Thread tension set;
S6: Set a main motor of the sewing machine in SECTOR 12;
C6: Main motor passed SECTOR 12;
S12: Set the presser foot in LIFT pos;
C11: Presser foot in LIFT pos;
S13: Set the upper thread control system in feeding mode;
C12: Feeding mode set;
S14: Provide the amount of extra thread (x) to be consumed in the cut sequence
C13: Delay (approx. 200 ms.)
S15: Move the embroidery frame x/2 mm in a set direction;
C14: Embroidery frame position set;
C15: Thread feed performed;
S8: Start thread fetcher of the thread cutter, motion 2;
C8: Motion 2 performed;
S16: Set the upper thread control system in tension mode;
C16: Tension mode set
S9: Set thread tension
C9: Thread tension set
S17: Set the presser foot in LOWERED pos
C17: Lowered pos. set
S10: Start thread fetcher, motion 3
C10: Motion 3 performed
S11: Calibrate the thread fetcher motor
C18: Calibration performed
S18: Set the presser foot in PIVOT pos;
C19: PIVOT pos. set;
S19: Move the embroidery frame −x/2 mm (to the pos. it had before the cut sequence started);
C20: Embroidery frame position set.

5. A computer program product coded with the steps for performing said method including the steps of the algorithms in any of claim 3 or 4.

6. A sewing machine comprising:

a thread feeder for the upper thread, a thread cutter, a fabric clamping member, a processor for controlling said thread cutter, said thread feeder and said fabric clamping member for performing the method of claim 1.

* * * * *

UNITED STATES PATENT AND TRADEMARK OFFICE

CERTIFICATE OF CORRECTION

PATENT NO. : 8,925,473 B2
APPLICATION NO. : 12/680736
DATED : January 6, 2015
INVENTOR(S) : Henrik Eklund et al.

It is certified that error appears in the above-identified patent and that said Letters Patent is hereby corrected as shown below:

In the Specification

Column 3, line 3, replace “la” with --1a--.

Signed and Sealed this
Thirty-first Day of March, 2015

Michelle K. Lee

Michelle K. Lee
*Director of the United States Patent and Trademark Office*